US012078348B2

(12) United States Patent
Boudreaux et al.

(10) Patent No.: US 12,078,348 B2
(45) Date of Patent: Sep. 3, 2024

(54) SYSTEMS AND METHODS FOR ONLINE CONTROL OF VOLATIZED CHEMICAL TREATMENT SOLUTIONS IN BOILER SYSTEMS

(71) Applicant: CHEMTREAT, INC., Glen Allen, VA (US)

(72) Inventors: Kevin Boudreaux, Sioux Falls, SD (US); Donald C. Roe, Willow, NY (US)

(73) Assignee: CHEMTREAT, INC., Glen Allen, VA (US)

( * ) Notice: Subject to any disclaimer, the term of this patent is extended or adjusted under 35 U.S.C. 154(b) by 422 days.

(21) Appl. No.: 17/535,132

(22) Filed: Nov. 24, 2021

(65) Prior Publication Data

US 2023/0160573 A1 May 25, 2023

(51) Int. Cl.

| | |
|---|---|
| ***F23N 5/26*** | (2006.01) |
| ***F23J 7/00*** | (2006.01) |
| ***F23J 15/02*** | (2006.01) |
| ***F23N 5/00*** | (2006.01) |

(52) U.S. Cl.

CPC ..... *F23N 5/265* (2013.01); *F23J 7/00* (2013.01); *F23J 15/02* (2013.01); *F23N 5/003* (2013.01); *F23J 2215/20* (2013.01)

(58) Field of Classification Search

CPC . F23J 7/00; F23J 15/02; F23J 2215/20; F23N 5/003; F23N 5/265

See application file for complete search history.

(56) References Cited

U.S. PATENT DOCUMENTS

| | | | | |
|---|---|---|---|---|
| 5,678,493 | A * | 10/1997 | Kelley | B03C 3/013 95/71 |
| 6,868,368 | B1 * | 3/2005 | Lang | G05B 13/042 702/182 |
| 2007/0119352 | A1 * | 5/2007 | Martin | C10L 10/04 432/2 |
| 2008/0210089 | A1 * | 9/2008 | Tsangaris | C10K 1/20 55/315.1 |
| 2010/0006014 | A1 * | 1/2010 | Smyrniotis | F23J 7/00 110/344 |
| 2019/0154256 | A1 | 5/2019 | Tabaries et al. | |

* cited by examiner

*Primary Examiner* — Alfred Basichas
(74) *Attorney, Agent, or Firm* — Oliff PLC

(57) ABSTRACT

Systems and methods for applying a volatized chemical treatment solution to a combustion chamber in a boiler system while the system is online. The method includes measuring a combustion parameter, determining in real time a dosage of the volatized chemical treatment solution based on the measured combustion parameter, and applying the volatized chemical treatment solution to the combustion chamber based on the determined dosage.

20 Claims, 3 Drawing Sheets

SYSTEMS AND METHODS FOR ONLINE CONTROL OF VOLATIZED CHEMICAL TREATMENT SOLUTIONS IN BOILER SYSTEMS

TECHNICAL FIELD

This application relates to systems and methods for automated online control of volatized chemical treatment solutions in boiler systems.

BACKGROUND

Impurities in fuels can cause deposit formation or slagging, fouling, and combustion-side or "fireside" metal surface corrosion in industrial boiler systems. Cold-end corrosion can also occur in cooler post-combustion zones, such as air heaters and pollution control equipment. These are serious problems. Boiler slag is a coarse, granular, and incombustible by-product that collects on the bottom of furnaces that burn fuel such as coal, wood, refuse, oil, and the like. Molten and/or hard glassy slag may also form on the walls and ceilings in a boiler firebox. Slag buildup results in a loss of heat transfer throughout the system, increases draft loss, limits gas throughput, and is a factor in tube failure due to erosion from excessive soot blowing.

Slag may comprise any number of metal oxides, including vanadium and sulfur compounds such as sulfur dioxide ($SO_2$) and sulfur trioxide ($SO_3$). $SO_2$ is a byproduct of burning fuels, including coal and heavy fuel oils that contain sulfur, which is can be oxidized to $SO_3$ during combustion in homogeneous and heterogeneous reactions. Most oxidation occurs in cooler (1000-1200° F.) sections of the boiler and is often catalyzed by vanadium, iron, and other metals. As the combustion gases work through combustion chambers, associated equipment, and ductwork, more of the $SO_3$ is formed and can cause cold-end corrosion and a visible acid plume. $SO_3$ vapor also readily converts to gaseous sulfuric acid when combined with water vapor as the combustion gases cool, and the $SO_3$ vapors form a fine aerosol mist, which can evade separation or capture in gas cleaning devices and exit the stack.

High concentrations of $SO_3$ in the boiler, stack, and/or plume cause adverse impacts to plant equipment and to the environment. Excessive stack emissions can create out-of-compliance situations, resulting in unfavorable publicity and/or fines. Left untreated, aesthetic problems with soot, smut, and other particulates building up on fireside surfaces can also occur, causing efficiency loss and potentially dangerous explosive conditions. Impacts on plant equipment may also require additional hardware or changes in operation, including load limits, to minimize $SO_3$ concentrations and the resulting adverse impacts.

For $SO_3$ control, injection of alkali material such as magnesium oxide has been used. However, this results in accumulation of solids along the furnace floor and duct walls. Solids accumulation may lead to an outage of a combustor or a process as well as inefficient reagent use and added expense of solids disposal. Another adverse effect of introducing magnesium oxide is that it tends to lighten the color of the heat exchange surfaces and thus making them reflective, causing reduction in their heat exchange efficiency. The combined effect on heat exchange efficiency and solids accumulation is not acceptable in many boiler systems.

A variety of procedures are also known for adding treatment chemicals to the fuel or into the furnace in quantities sufficient to treat the slagging problem. More recent technology provides for targeted chemical introduction where the chemical is directed at trouble spots in a boiler. But waiting for $SO_3$ remediation can leave hot-end slagging and corrosion problems untreated and result in such high $SO_3$ concentrations at the cold end that residence times for treatment and chemical dosages will be far too costly. For many boilers, operators have been forced to let the problems occur and then shut the boiler system down for cleaning, which is also an undesirable option.

Moreover, conventional approaches rely on base feeding and do not automate or optimize dosing based on any key performance indicators (KPIs). This results in an overall increase in inefficiency and expense. As a result, there is a substantial need for better methods for assessing slagging, fouling, and/or corrosion demand and automating anti-slagging, fouling, and/or corrosion feed patterns based on the demand without adversely affecting the efficiency of the combustor burning the problem fuels. These and other issues are addressed by the follow disclosed embodiments.

SUMMARY

Disclosed embodiments address the myriad of issues $SO_3$ induces in the fireside of boiler systems by providing an automated, online solution to controlling application of volatized chemical treatment solutions to boiler systems. Disclosed embodiments also implement a novel way of monitoring and controlling $SO_3$ concentrations as well as a novel method for automating and optimizing the proprietary product dosing.

The inventors have demonstrated that an online sensor used in a fireside of boiler systems may provide for the accurate and precise determination of volatized chemical treatment solution for treating equipment in boiler systems.

Thus, in some aspects, the disclosed embodiments provide for comprehensive systems and methods, including a programmable logic controller (PLC), and an algorithm package that enables continuous, reliable, and accurate monitoring of slagging, fouling, and/or corrosion in industrial boiler systems.

In one embodiment, there is provided a method for applying a volatized chemical treatment solution to a combustion chamber in a boiler system. The method comprises, while the system is online, measuring a combustion parameter, determining in real time a dosage of the volatized chemical treatment solution based on the measured combustion parameter, and applying the volatized chemical treatment solution to the combustion chamber based on the determined dosage.

In another embodiment, there is provided a non-transitory computer readable storage medium storing a program for causing a computer to execute the above method.

In another embodiment, there is provided a system for applying a volatized chemical treatment solution to a combustion chamber in a boiler system. The system comprises a sensor configured to measure a combustion parameter while the system is online, and a controller configured to execute the steps of determining in real time a dosage of the volatized chemical treatment solution based on the measured combustion parameter, and applying the volatized chemical treatment solution to the chamber based on the determined dosage.

BRIEF DESCRIPTION OF THE DRAWINGS

Disclosed embodiments are illustrated and described herein with reference to the various drawings, in which like reference numbers are used to denote like system components/method steps, as follows.

DETAILED DESCRIPTION

Figure 1:
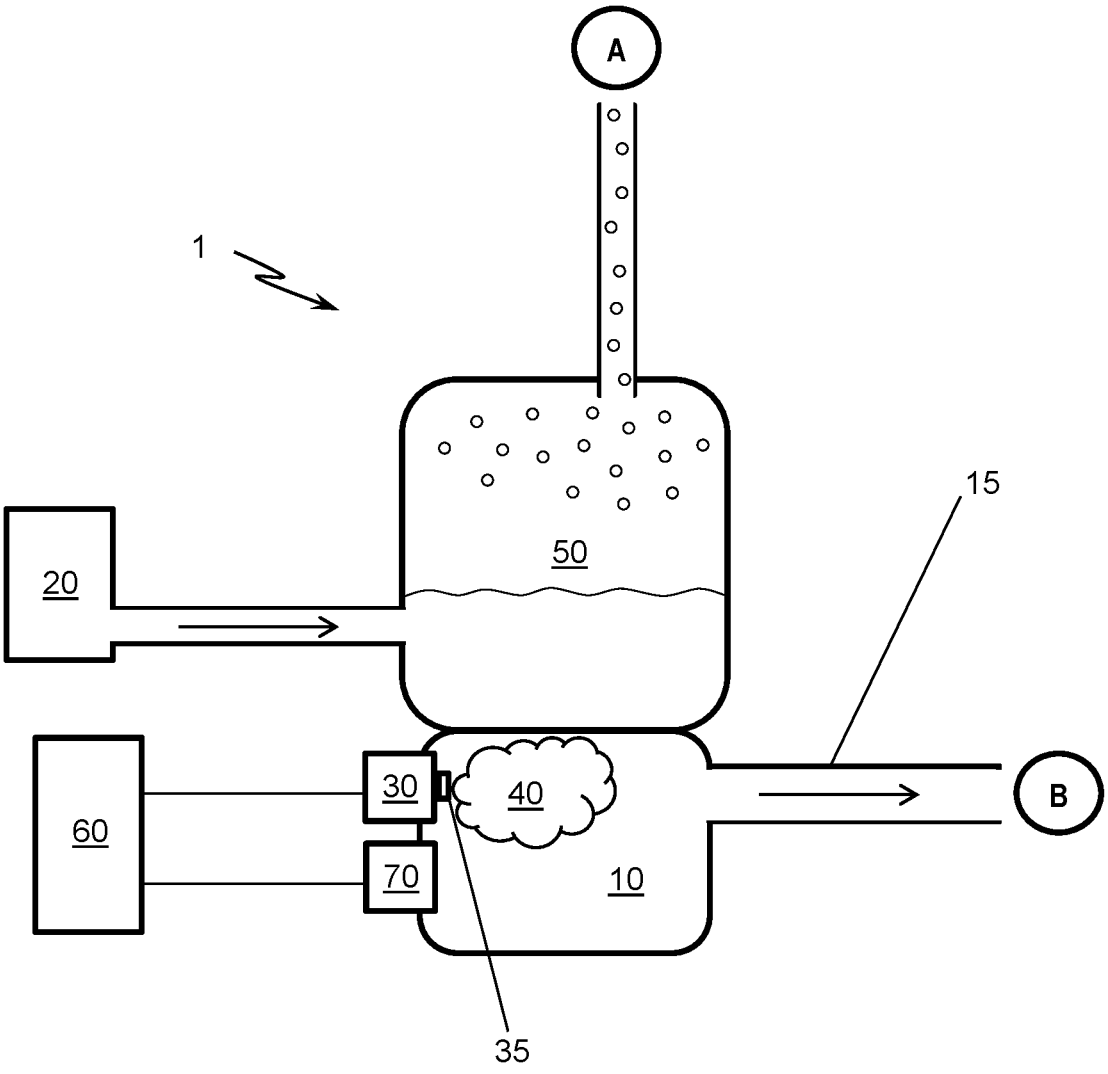
FIG. 1 is a schematic diagram of a boiler system according to an embodiment.
Figure 2:
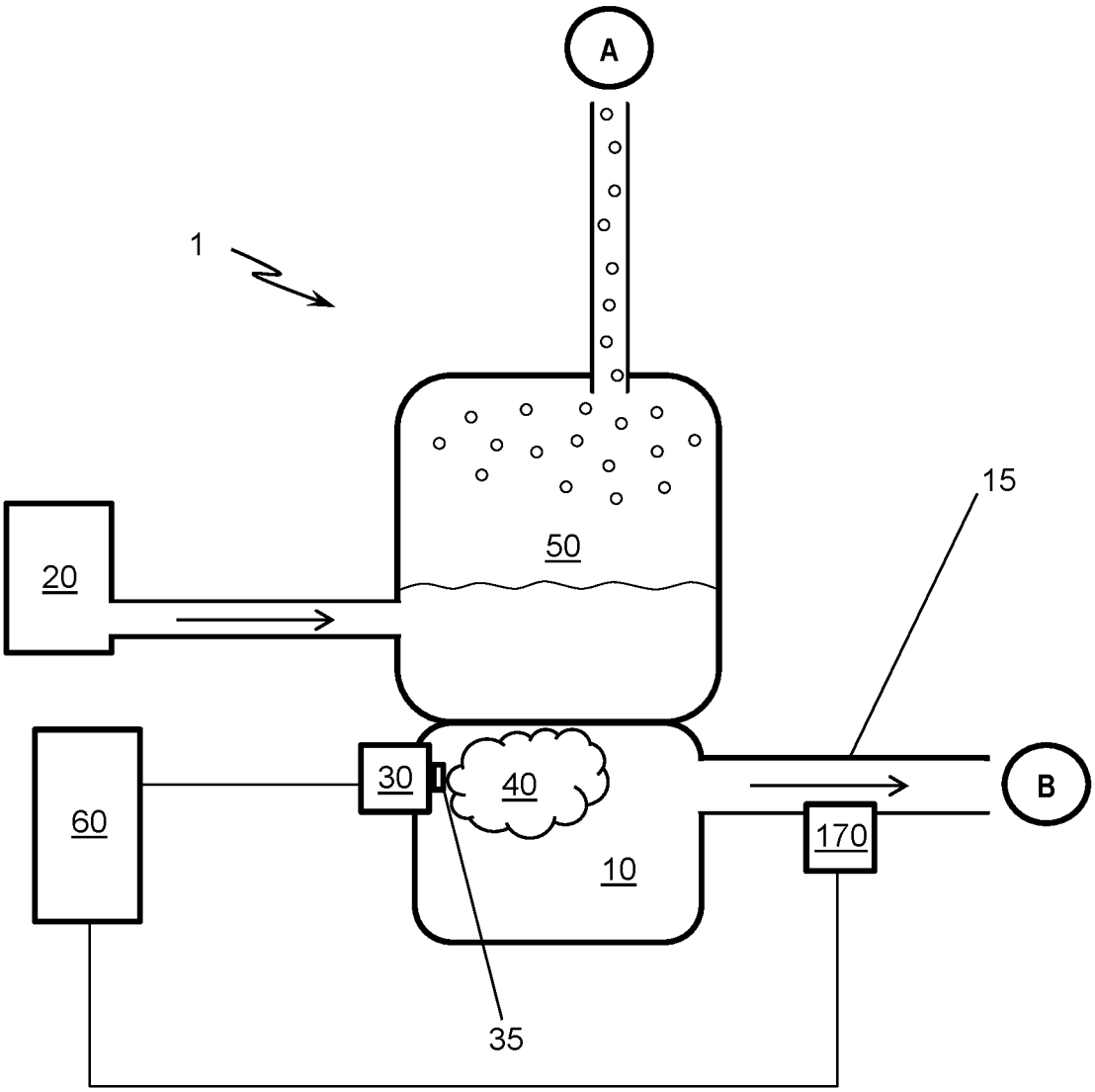
FIG. 2 is a schematic diagram of a boiler system according to an embodiment.

Disclosed embodiments provide for systems and methods for applying a volatized chemical treatment solution to combustion chambers in boiler systems. FIGS. 1 and 2 illustrate boiler systems configured with systems for applying a volatized chemical treatment solution to combustion chambers, e.g., pre-combustion, combustion, and post-combustion chambers, according to disclosed embodiments.

With reference to FIGS. 1 and 2, disclosed embodiments include applying a volatized chemical treatment solution to a combustion chamber of a boiler system 1. The system 1 includes a boiler 50 for holding water. A water source 20 supplies water to the boiler 50 in the direction of the arrow shown in FIGS. 1 and 2. A combustion chamber or combustor 10 holds a fuel for combustion and heats the water in the boiler 50. The water in the boiler 50 evaporates to steam which exists to process or processes A. Flue gas from the combustion chamber 10 vents via gas outlet 15 to B, as seen in FIGS. 1 and 2. The boiler system 1 also includes a distributed control system (DCS) of PLC 60 in communication with the sensing device 70/170 and dispensing device 30.

As used herein, the term "aerosol" refers to small particles (dust, solids) or droplets (liquid phase or mist) suspended in air, or a material which is dispensed from its container as a mist, spray, or foam by a propellant under pressure.

As used herein, the term "dust" refers to small solid particles, conventionally taken as those particles below 75 μm in diameter, which settle out under their own weight but which may remain suspended for some time.

As used herein, the term "fuel" refers to coal, wood, refuse, oil, and the like, suitable for heating a medium, such as water, in a boiler system.

As used herein, the term "fume" refers to particles formed when a volatilized solid, such as a metal, condenses in cool air. This physical change is often accompanied by a chemical reaction, such as oxidation.

As used herein, the term "mist" refers to liquid droplets of a substance or mixture suspended in a gas (usually air).

As used herein, the term "online" refers to a measurement being taken and recorded while the boiler system is operational, fuel is combusted and water/steam is processed through equipment, as opposed to being "offline" when operation ceases.

As used herein, the terms "particulate matter" or "airborne particulate matter" refer to as dust, dirt, soot, smoke, and liquid droplets which when emitted into the air, is small enough to be suspended in the atmosphere.

As used herein, the term "smoke" refers to airborne solid and/or liquid particles, exclusive of water vapor, released into the atmosphere from a process of combustion.

The Volatized Chemical Treatment Solution

Disclosed embodiments include applying a volatized chemical treatment solution to the combustion chamber 10 of the boiler system 1. The chemical treatment solution may include any suitable metallic or organometallic compound capable of volatilization and controlling combustion slagging, fouling and/or corrosion. For example, suitable compounds may include, but are not limited to, aluminum, barium, copper, iron, magnesium, manganese, and silica, and salts thereof.

In embodiments, the compound may be a salt of a magnesium compound. The salt of the magnesium compound may be at least one selected from the group consisting of magnesium nitrate, magnesium acetate, magnesium sulfate, and magnesium chloride. Preferably, the salt of the magnesium compound is magnesium nitrate.

A concentration of the magnesium salt in the volatized chemical treatment solution may be present in any suitable amount. For example, the concentration of the magnesium salt maybe present in the solution in a range of 0.1% to 100%, 0.1% to 50%, 1% to 20%, or 1% to 10%, by weight.

The volatized chemical treatment solution may include other compounds, including anti-scalants, corrosion inhibitors, and/or surfactants. The concentration of these elements maybe present in the solution, individually or in combination, in a range of 0.1% to 100%, 0.1% to 50%, 1% to 20%, or 1% to 10%, by weight.

Any suitable scaling inhibitors may be used in the chemical treatment solution including, but not limited to, hydroxyethylidene diphosphonic acid (HEDP), phosphonobutane tricarboxylate (PBTC), polyamino polyether methylenephosphonate (PAPEMP), amino-tris-methylene phosphonate (AMP), diethylenetriaminepenta(methylene-phosphonate) (DETPMPA), polymaleic anhydride (PMA), acrylic acid/acrylamido methyl prone-sulfonate (AA/AMPS), phosphino-carboxylic acid polymer (PCA), polyacrylic acid (PAA), and mixtures thereof. It will be understood that the precise make-up of the anti-scalant(s) in the chemical treatment solution will be dependent upon the requisite slagging, fouling and/or corrosion control plan and system operating conditions.

The chemical treatment solution may include at least one surfactant selected from the group consisting of ethoxylated nonylphenols, phosphate esters, and nonionic glucosides. The chemical treatment solution may include at least one a calcium salt inhibitor selected from the group consisting of 2-phosphonobutane-1,2,4-tricarboxylic acid, and 1-hydroxyethylene-1, 1-diphosphonic acid. The balance may be water.

Methods for Applying the Volatized Chemical Treatment Solution to the Boiler System The disclosed methods for applying the volatized chemical treatment solution to a combustion chamber in a boiler system may include a step of measuring a combustion parameter. As used herein, a combustion "parameter" refers to any element, product, or byproduct of combustion or a combustion reaction, including, but not limited to, a measured parameter of the combusted gases, mists, dusts, and the like, i.e., those in the combustion, chamber, duct work, gas or flue gas outlets, and the like.

As seen in FIG. 1, disclosed systems and methods may employ an online sensing device 70 for measuring a concentration of a combustion parameter(s) in the combustion chamber. In embodiments, the parameter may be least one of a content of $SO_3$, a content of $SO_2$, and a sulfuric acid dewpoint. The sensing device 70 may be any suitable sensing or measurement device known in the art. For example, the sensing device 70 may include one or more probes for measuring the parameter(s), a filter such as, for example, a porous glass fiber filter, and/or collecting tube.

FIG. 2 illustrates another embodiment where disclosed systems and methods employ an online sensing device 170 for measuring a concentration of a combustion parameter(s)

in the gas outlet 15. In embodiments, the parameter may be least one of a content of $SO_3$, a content of $SO_2$, and a sulfuric acid dewpoint. The sensing device 70 may be any suitable sensing or measurement device known in the art. For example, the sensing device 70 may include one or more probes for measuring the parameter(s), a filter such as, for example, a porous glass fiber filter, and/or collecting tube.

In other embodiments, disclosed systems and methods may employ both an online sensing device 70 and an online sensing device 170 for measuring the concentration of the combustion parameter(s) in the combustion chamber 10 and gas outlet 15, respectively.

Generally speaking, every 1 ppm by volume of $SO_3$ will contribute from 1 to 3% opacity. Thus, exhaust gas concentrations of only 10 to 20 ppm $SO_3$ can cause opacity and acid plume problems. In addition, deposition or formation of acid on any metal surfaces below the acid dew point causes corrosion within the unit that affects all equipment along the flue gas path such as the air heater, duct work and stack liners. In a combustion chamber, sulfur in the oil (e.g., 1-5%) forms $SO_2$, some of which is oxidized to $SO_3$, which can condense as sulfuric acid on the back end surfaces (where the temperature has typically been reduced to less than about 150° C.) and promote corrosion and acid plume. The one or more probes of the sensing device 70/170 are configured to measure the content of $SO_3$ and $SO_2$, and the sulfuric acid dewpoint throughout this transformation in the various chambers (e.g., the combustion chamber 10 and gas outlet 15), i.e., in the gas or combustion products of the combustion reactions.

The sensing device 70/170 has measurement capability in real-time, i.e., continuously, or at near real-time, or intervals with a testing frequency being within predetermined intervals. In various embodiments, the intervals may be less than 5 minutes, less than 10 minutes, less than 15 minutes, less than 20 minutes, less than 30 minutes, less than 1 hour, less than 2 hours, less than 6 hours, or less than 12 hours. The intervals may be in the range of 1 minute to 24 hours, 1 minute to 12 hours, 5 minutes to 12 hours, 10 minutes to 6 hours, 15 minutes to 2 hours, 20 minutes to an hour, or 30 minutes to an hour. The frequency employed in measurements taken in the disclosed embodiments may depend on the particular system, including the slagging, fouling, and/or corrosion dynamics of that system Preferably, the sensing device 70/170 of the disclosed embodiments is made of materials that are customized to the environment that they are to be used in, and are designed to chemically withstand the environment and exhibit wear resistance caused by aggressive gasses and high-temperatures. The electronic transmission function can use the latest technology. Solid state construction can be completely sealed and customized to the environment. Internal O-rings can be omitted as these degrade and are prone to failure. Gels and electrolytes are preferably not used as these can easily contaminate and increase maintenance. A large surface area can be used that reduces fouling and improves reliability. Glass characteristics result in very low drift and reliable readings over prolonged periods, e.g., 2-4 weeks. Glass construction can be highly durable, and double and triple-junction construction provides long life.

The disclosed method for applying a volatized chemical treatment solution to a combustion chamber in a boiler system may include a step of determining in real time a dosage of the volatized chemical treatment solution based on the measured parameter(s). Disclosed embodiments provide systems and methods that use measured parameters to determine time of a dosage of the volatized chemical treatment solution and provide real-time adjustments in chemical dosing to the boiler system 1. This determination greatly reduces the $SO_3$ deposition in a more comprehensive and economical manner from existing technologies. The solution incorporates reliable monitoring of the salient parameters, which are used to calculate the critical data points in real time via a PLC, and utilizes a feed-forward loop through the DCS to adjust chemical dosing based upon the data obtained. The ability to calculate the slagging, fouling, and/or corrosion potential greatly improves the process performance and can extend the "run time" for the boiler system, which typically must shut down for slagging, fouling, and/or corrosion issues. This data is then integrated into a PLC algorithm that is fed into the DCS 60 to compare current data versus setpoint data. Deviations (+ or −) from the setpoint system data enable the dispensing device 30 to adjust the feed rate for the current situation.

The disclosed method for applying a volatized chemical treatment solution to a combustion chamber in a boiler system may include a step of controlling application of the volatized chemical treatment solution to the combustion chamber based on the determined dosage.

In embodiments, controlling application of the volatized chemical treatment solution to the process stream may include controlling a rate of application of the volatized chemical treatment solution. The rate of the volatized chemical treatment solution applied is increased or decreased during a time period corresponding to a time period of increased seasonal or operational load on the boiler system. Controlling application of the volatized chemical treatment solution to the process stream may include controlling an amount of the volatized chemical treatment solution applied. The amount of the volatized chemical treatment solution applied is increased or decreased during a time period corresponding to a time period of increased or decreased seasonal or operational load on the boiler system.

In embodiments, the volatized chemical treatment solution may be introduced into the combustion chamber 10 or applied directly to the fuel prior to entering the combustion chamber 10. As seen in FIGS. 1 and 2, the boiler system 1 includes a dispensing device 30 for dispensing the chemical treatment solution. In embodiments, the dispensing device 30 may be pressurized for volatizing the chemical treatment solution. The volatilization may occur by any suitable means known in the art including, but not limited to, vaporization and atomization. The dispensing device 30 may include a nozzle 35 for spraying the volatized chemical treatment solution into the combustion chamber 10.

As seen in FIGS. 1 and 2, the volatized chemical treatment solution is sprayed in a manner that creates a fume 40. The volatized chemical treatment solution may also be applied as a dust, particulate matter, smoke, fume, mist, and/or aerosol. A particle size of the metallic salt in the volatized chemical treatment solution may be, for example, in the range of 0.01 to 100 micron, 0.1 to 10 micron, 0.1 to 1.0 micron, or 0.2 and 0.25 micron.

The fume 40 creates a significant surface area with which to react when compared with conventional solution injection methods. The fume 40 allows for the dosage optimization not possible with conventional methods. Once the fume 40 is created, it reacts with the $SO_3$ in the flue gas, thus creating an inert reactant such as, for example, magnesium sulfate when magnesium nitrate is used as the compound in the chemical treatment solution. The reactions which occur are as follows:

First, in a thermal decomposition step of converting $Mg(NO_3)_2$ to MgO:

$$Mg(NO_3)_2 = MgO + NO_2 + O_2$$

Second, the pure MgO reaction product then reacts with $SO_3$:

$$MgO + SO_3 \rightarrow MgSO_4$$

Unlike $SO_3$ compounds, $MgSO_4$ is inert and does not form boiler corrosion deposits and other issues. Furthermore, minimizing the $SO_3$ reduces the potential for acid formation.

According to disclosed methods, online automated control of the chemical treatment feed operation is effected based on the measured parameter(s) using the DCS 60 in communication with the sensing device 70 and dispensing device 30. For example, chemical feed for scale control has been based on experience and/or economic conditions. However, excessive feeding can increase operating costs and too little feeding can cause slagging, fouling and/or corrosion and production problems. Dosing may be controlled by a dosing pump and pump timer.

The advantages of this system include, but are not limited to, chemical feed is based upon system data metrics (e.g., measurements of the content of $SO_3$, the content of $SO_2$, and the sulfuric acid dewpoint measurements), chemical feed is optimized, and is not necessarily consistent hour to hour, but is optimized by key metrics, chemical feed is decreased when needed or increased, thereby annual chemical spending is optimized for the process, alarms are established and triggered if the slagging, fouling, and/or corrosion increases greatly, and boiler equipment has greatly reduced build-up of slagging, fouling, and/or corrosion thereby improving energy usage, extending component life, reducing CapEx costs (i.e., replacement), and extending year-to-year run cycle for the boiler system.

Real-time results enable greater system chemical treatment response and control, thereby enhancing process performance and extending the operational months for a given plant as slagging, fouling, and/or corrosion are greatly diminished.

In other embodiments, there is a provided a non-transitory computer-readable medium stored in a memory and executed by a processor to execute method steps for boiler applications. The steps may include sampling a plurality of characteristics using a plurality of sensors, calculating one or more of the content of $SO_3$, the content of $SO_2$, and the sulfuric acid dewpoint based on the plurality of characteristics using a measurement unit coupled to the plurality of sensors, and injecting one or more anti-slagging, fouling, and/or corrosion chemicals into the system responsive to the calculated one or more of the measured parameters.

Online Measurement and Recordation

The systems and methods of the disclosed embodiments incorporate existing technologies, in a novel control scheme that has never been successfully deployed in the past—because, the reliability of components has not existed until very recently. Functionally, this idea is novel, because control of anti-lagging, fouling, and/or corrosion feed has never been automated in boiler systems. Combining all the needed components into a deployed process control scheme enables the boiler process to be protected from slagging, fouling, and/or corrosion and operational limitations.

Chemical Feed Automation and Control

Using the online measurements from above, anti-slagging, fouling, and/or corrosion treatment solutions are able to be controlled, i.e., adjusted and optimized, while the system is online, thereby increasing overall efficiency and reducing costs.

Similarly, the dosage control plan for the application of the treatment solutions will be dependent upon the specific contents of the anti-slagging, fouling, and/or corrosion treatment solutions, the control plan and system operating conditions. According to the online methods, the dosage amount and rate curves can be developed for each treatment solution applied, to thereby allow for the change in dosage amounts and rates based on the measured parameters.

Figure 3:
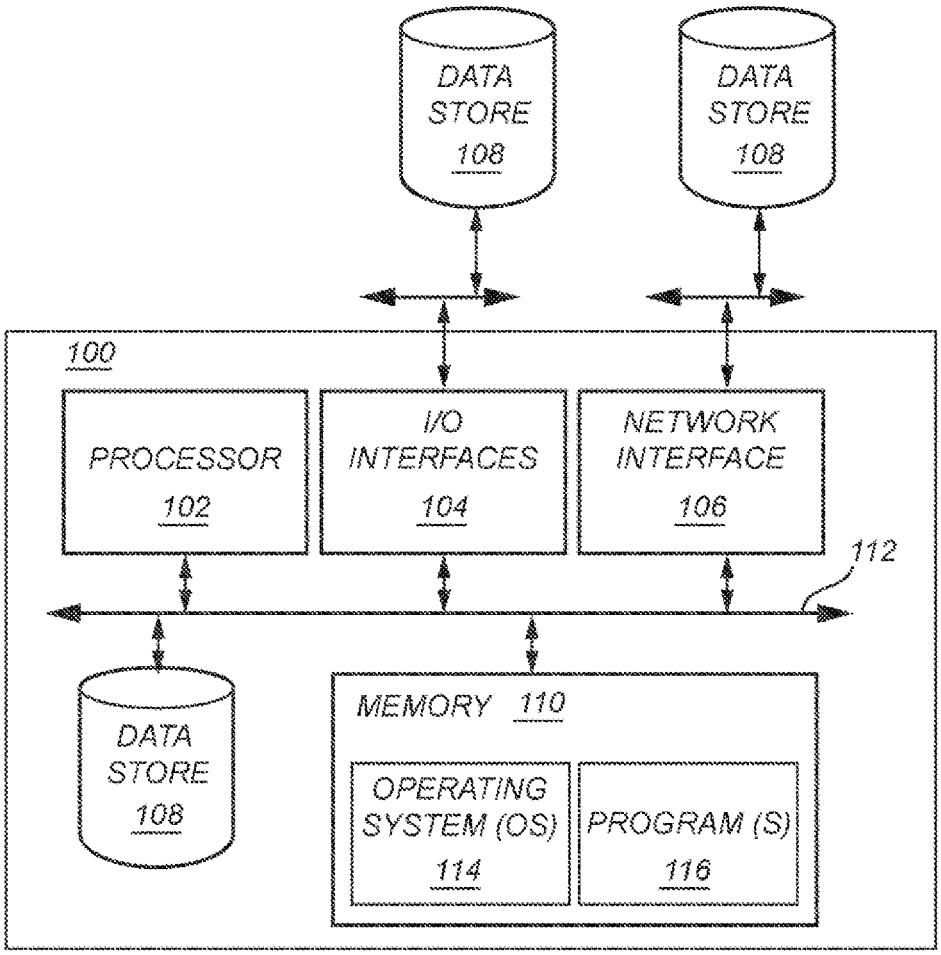
FIG. 3 is a block diagram of a computer server which may be used in a DCS system according to embodiments.

Referring now specifically to FIG. 3, the DCS 60 may include one or more computers or servers 100, which may be used stand-alone or in a networked or cloud-based system. In terms of hardware architecture, the computer or server 100 generally includes a processor 102, input/output (I/O) interfaces 104, a network interface 106, a data store 108, and memory 110 storing a non-transitory computer-readable medium including executable instructions. It should be appreciated by those of ordinary skill in the art that FIG. 3 depicts the computer/server 100 in an oversimplified manner, and a practical embodiment may include additional components and suitably configured processing logic to support known or conventional operating features that are not described in detail herein. The components (102, 104, 106, 108, and 110) are communicatively coupled via a local interface 112. The local interface 112 may be, for example, but is not limited to, one or more buses or other wired or wireless connections, as is known in the art. The local interface 112 may have additional elements, which are omitted for simplicity, such as controllers, buffers (caches), drivers, repeaters, and receivers, among many others, to enable communications. Further, the local interface 112 may include address, control, and/or data connections to enable appropriate communications among the aforementioned components.

The processor 102 is a hardware device for executing software instructions. The processor 102 may be any custom made or commercially available processor, a central processing unit (CPU), an auxiliary processor among several processors associated with the computer/server 100, a semiconductor-based microprocessor (in the form of a microchip or chipset), or generally any device for executing software instructions. When the computer/server 100 is in operation, the processor 102 is configured to execute software stored within the memory 110, to communicate data to and from the memory 110, and to generally control operations of the computer/server 100 pursuant to the software instructions. The I/O interfaces 104 may be used to receive user input from and/or for providing system output to one or more devices or components.

The network interface 106 may be used to enable the computer/server 100 to communicate on a network, such as the Internet. The network interface 106 may include, for example, an Ethernet card or adapter (e.g., 10BaseT, Fast Ethernet, Gigabit Ethernet, or 10 GbE) or a Wireless Local Area Network (WLAN) card or adapter (e.g., 802.11a/b/g/n/ac). The network interface 106 may include address, control, and/or data connections to enable appropriate communications on the network. A data store 108 may be used to store data. The data store 108 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 108 may incorporate electronic, magnetic, optical, and/or other types of storage media. In one example, the data store 108 may be located internal to the computer/server 100, such as, for example, an internal hard drive connected to the local interface 112 in the computer/server 100. Additionally, in another embodiment, the data store 108 may be located external to the computer/server 100, such as, for example, an external hard drive connected to the I/O interfaces 104 (e.g., a SCSI or USB connection). In a further embodiment, the data store 108 may be connected to the computer/server 100 through a network, such as, for example, a network-attached file server.

The memory 110 may include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 110 may incorporate electronic, magnetic, optical, and/or other types of storage media. Note that the memory 110 may have a distributed architecture, where various components are situated remotely from one another but can be accessed by the processor 102. The software in memory 110 may include one or more software programs, each of which includes an ordered listing of executable instructions for implementing logical functions. The software in the memory 110 includes a suitable operating system (O/S) 114 and one or more programs 116. The operating system 114 essentially controls the execution of other computer programs, such as the one or more programs 116, and provides scheduling, input-output control, file and data management, memory management, and communication control and related services. The one or more programs 116 may be configured to implement the various processes, algorithms, methods, techniques, etc. described herein.

It will be appreciated that some embodiments illustrated herein may include one or more generic or specialized processors ("one or more processors") such as microprocessors; central processing units (CPUs); digital signal processors (DSPs); customized processors such as network processors (NPs) or network processing units (NPUs), graphics processing units (GPUs), or the like; field programmable gate arrays (FPGAs); and the like along with unique stored program instructions (including both software and firmware) for control thereof to implement, in conjunction with certain nonprocessor circuits, some, most, or all of the functions of the methods and/or systems described herein. Alternatively, some or all functions may be implemented by a state machine that has no stored program instructions, or in one or more application-specific integrated circuits (ASICs), in which each function or some combinations of certain of the functions are implemented as custom logic or circuitry. Of course, a combination of the aforementioned approaches may be used. For some of the embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various embodiments.

Moreover, some embodiments may include a non-transitory computer-readable storage medium having computer-readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a Read-Only Memory (ROM), a Programmable Read-Only Memory (PROM), an Erasable Programmable Read-Only Memory (EPROM), an Electrically Erasable Programmable Read-Only Memory (EEPROM), flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various illustrative embodiments.

It is to be recognized that, depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

Referring again specifically to FIGS. 1 and 2, the DCS 60 directs the dispensing of the chemical treatment solution into the combustion chamber 10 of the boiler system 1. Thus, the dispensing device 30 may include an appropriate dosing pump and conduit, as is well known to those of ordinary skill in the art. The sensing device 70/170 sends its signals to the PLC controller to determine the proper chemical dose using a site-specific algorithm. The dosing algorithm is established at each site because of make-up water chemistry variation and anti-slagging, fouling, and/or corrosion product selection, but, essentially, the algorithm can use a model. Anti-slagging, fouling, and/or corrosion selection chemistry is varied and has degrees of effectiveness in any given boiler system. Therefore, once the system is analyzed and anti-slagging, fouling, and/or corrosion selection is determined, the graph can be modified slightly and incorporated into the local algorithm. Based on the local model and the resultant calculation, the PLC will send the dosing algorithm to the DCS from which the DCS can make needed adjustments to the chemical feed pump. The dosing need of anti-slagging, fouling, and/or corrosion treatment can be automatically adjusted from a setpoint level (up or down) with a signal from the DCS to the chemical feed pump.

The disclosed embodiments are unique in several ways. The slagging, fouling, and/or corrosion measurements are predictors of the potential for slagging, fouling, and/or corrosion.

Consequently, the value of anti-slagging, fouling, and/or corrosion dosage can be set to prevent these problems. It is therefore a proactive online key performance indicator rather than reactive like the conventional performance monitors.

Real-time results enable greater system chemical treatment response and control, thereby enhancing process performance and extending the operational months for a given boiler system as slagging, fouling, and/or corrosion are greatly diminished.

Additionally, the programmable logic behind the anti-slagging, fouling, and/or corrosion dosage can be refined in the field in response to real-time real-world conditions and performance at the site. And adjustments to anti-slagging, fouling, and/or corrosion dosages can be made virtually instantaneously, or a reading from a deposit monitor, and the subsequent follow-up manual adjustment of the anti-slagging, fouling, and/or corrosion feed pump. As a result, the disclosed embodiments will provide real-time and more effective slagging, fouling, and/or corrosion control management compared to conventional processes by improving the overall reliability, efficiency, and economic productivity of the boiler system.

Embodiments may further include machine learning algorithms implemented on the disclosed controllers for executing the disclosed functions in a predictive manner. For example, the machine learning algorithms may be used to establish historical patterns to predict future feed needs based on any one or more parameters that may include, but are not limited to, time of day, time of year, current weather, rainfall, and other process inputs. Outputs of the predictive logic controllers may be connected to, for example, a weather station to provide ambient weather data or other external reporting and analysis site such as inventory control device.

The programmatic tools used in developing the disclosed machine learning algorithms are not particularly limited and may include, but are not limited to, open source tools, rule engines such as Hadoop®, programming languages including SAS®, SQL, R and Python and various relational database architectures.

Each of the disclosed controllers may be a specialized computer(s) or processing system(s) that may implement machine learning algorithms according to disclosed embodiments. The computer system is only one example of a suitable processing system and is not intended to suggest any limitation as to the scope of use or functionality of embodiments of the methodology described herein. The processing system shown may be operational with numerous other general purpose or special purpose computing system environments or configurations. Examples of well-known computing systems, environments, and/or configurations that may be suitable for use with the disclosed embodiments may include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

The computer system may be described in the general context of computer system executable instructions, such as program modules, being executed by a computer system. Generally, program modules may include routines, programs, objects, components, logic, data structures, and so on that perform particular tasks or implement particular abstract data types. The computer system may be practiced in distributed cloud computing environments where tasks are performed by remote processing devices that are linked through a communications network. In a distributed cloud computing environment, program modules may be located in both local and remote computer system storage media including memory storage devices.

It will be appreciated that the above-disclosed features and functions, or alternatives thereof, may be desirably combined into different methods and systems. Also, various alternatives, modifications, variations or improvements may be subsequently made by those skilled in the art, and are also intended to be encompassed by the disclosed embodiments. As such, various changes may be made without departing from the spirit and scope of this disclosure.

The invention claimed is:

1. A method for applying a volatized chemical treatment solution to a combustion chamber in a boiler system, the method comprising, while the system is online:

measuring a concentration of a combustion parameter;

determining in real time a dosage of the volatized chemical treatment solution based on the measured concentration of the combustion parameter; and applying the volatized chemical treatment solution to the combustion chamber based on the determined dosage.

2. The method for applying a volatized chemical treatment solution to a combustion chamber according to claim 1, wherein the combustion parameter is at least one of a content of $SO_3$, a content of $SO_2$, and a sulfuric acid dewpoint.

3. The method for applying a volatized chemical treatment solution to a combustion chamber according to claim 1, wherein the volatized chemical treatment solution is applied as at least one of a dust, particulate matter, smoke, fume, mist, and aerosol.

4. The method for applying a volatized chemical treatment solution to a combustion chamber according to claim 3, wherein the volatized chemical treatment solution is applied as a fume.

5. The method for applying a volatized chemical treatment solution to a combustion chamber according to claim 1, wherein the volatized chemical treatment solution is applied to the combustion chamber by spraying.

6. The method for applying a volatized chemical treatment solution to a combustion chamber according to claim 1, wherein the volatized chemical treatment solution includes a salt of a magnesium compound.

7. The method for applying a volatized chemical treatment solution to a combustion chamber according to claim 1, wherein the salt of the magnesium compound is at least one selected from the group consisting of magnesium nitrate, magnesium acetate, magnesium sulfate, and magnesium chloride.

8. The method for applying a volatized chemical treatment solution to a combustion chamber according to claim 1, wherein the salt of the magnesium compound is magnesium nitrate.

9. The method for applying a volatized chemical treatment solution to a combustion chamber according to claim 8, wherein a concentration of the magnesium nitrate in the volatized chemical treatment solution is in a range of 1% to 10% by weight.

10. The method for applying a volatized chemical treatment solution to a combustion chamber according to claim 1, wherein the volatized chemical treatment solution includes at least one surfactant selected from the group consisting of ethoxylated nonylphenols, phosphate esters, and nonionic glucosides.

11. The method for applying a volatized chemical treatment solution to a combustion chamber according to claim 1, wherein the concentration of the combustion parameter is measured in at least one of the combustion chamber and a gas outlet.

12. The method for applying a volatized chemical treatment solution to a combustion chamber according to claim 1, wherein the combustion parameter is measured continuously.

13. The method for applying a volatized chemical treatment solution to a combustion chamber according to claim 1, wherein the combustion parameter is measured in intervals.

14. The method for applying a volatized chemical treatment solution to a combustion chamber according to claim 1, wherein applying the volatized chemical treatment solution to the combustion chamber includes controlling a rate of application of the volatized chemical treatment solution.

15. The method for applying a volatized chemical treatment solution to a combustion chamber according to claim 14, wherein the rate of the volatized chemical treatment solution applied is increased or decreased during a time period corresponding to a respective time period of increased or decreased seasonal or operational load on the boiler system.

16. The method for applying a volatized chemical treatment solution to a combustion chamber according to claim 1, wherein the step of applying the volatized chemical treatment solution to the combustion chamber includes controlling an amount of the volatized chemical treatment solution applied.

17. The method for applying a volatized chemical treatment solution to a combustion chamber according to claim 16, where the amount of the volatized chemical treatment solution applied is increased or decreased during a time period corresponding to a respective time period of increased or decreased seasonal or operational load on the boiler system.

18. The method for applying a volatized chemical treatment solution to a combustion chamber according to claim 1, wherein a particle size of the volatized chemical treatment solution is in a range of 0.1 to 1.0 μm.

19. A non-transitory computer readable storage medium storing a program for causing a computer to execute the method as claimed in claim 1.

20. A system for applying a volatized chemical treatment solution to a combustion chamber in a boiler system, the system comprising:

a sensor configured to measure a concentration of a combustion parameter while the system is online;

a controller configured to execute the steps of:

determining in real time a dosage of the volatized chemical treatment solution based on the measured combustion parameter, and applying the volatized chemical treatment solution to the combustion chamber based on the determined dosage.

* * * * *